US006135722A

United States Patent [19]

Kawaguchi et al.

[11] Patent Number: 6,135,722

[45] Date of Patent: Oct. 24, 2000

[54] POSITIONAL RELATIONSHIP OF A BEARING IN THE SHUTOFF MEMBER OF A VARIABLE DISPLACEMENT COMPRESSOR

[75] Inventors: Masahiro Kawaguchi; Masanori Sonobe; Takuya Okuno; Ken Suitou, all of Kariya, Japan

[73] Assignee: Kabushiki Kaisha Toyoda Jidoshokki Seisakusho, Kariya, Japan

[21] Appl. No.: 08/909,708

[22] Filed: Aug. 11, 1997

[30] Foreign Application Priority Data

Aug. 12, 1996 [JP] Japan ..... 8-212389

[51] Int. Cl.[7] ..... F04B 1/29

[52] U.S. Cl. ..... 417/222.2; 417/270

[58] Field of Search ..... 417/222.1, 222.2, 417/270; 92/71

[56] References Cited

U.S. PATENT DOCUMENTS

| | | | |
|---|---|---|---|
| 5,577,894 | 11/1996 | Kawaguchi et al. . | |
| 5,584,670 | 12/1996 | Kawaguchi et al. . | |
| 5,603,610 | 2/1997 | Kawaguchi et al. . | |
| 5,616,008 | 4/1997 | Yokono et al. | 417/222.2 |
| 5,624,240 | 4/1997 | Kawaguchi et al. | 417/222.2 |
| 5,636,973 | 6/1997 | Sonobe et al. | 417/222.2 |
| 5,681,150 | 10/1997 | Kawaguchi et al. . | |
| 5,785,502 | 7/1998 | Ota et al. | 417/270 |
| 5,871,337 | 2/1999 | Fukanuma et al. | 417/222.2 |

FOREIGN PATENT DOCUMENTS

| | | | |
|---|---|---|---|
| 340024 | 11/1989 | European Pat. Off. | 417/222.2 |
| 0628722 | 12/1994 | European Pat. Off. . | |
| 0 716 228 A1 | 6/1996 | European Pat. Off. . | |
| 44 39512A1 | 5/1995 | Germany . | |
| 44 46832A1 | 6/1995 | Germany . | |
| 195 14376A1 | 10/1995 | Germany . | |
| 195 17334A1 | 11/1995 | Germany . | |

*Primary Examiner*—Charles G. Freay
*Assistant Examiner*—Cheryl J. Tyler
*Attorney, Agent, or Firm*—Morgan & Finnegan, L.L.P.

[57] ABSTRACT

A variable displacement refrigerant compressor has a tilting swash plate connected to a number of pistons. The pistons are located in a cylinder block. The cylinder has a front end surface that faces the swash plate. A central bore is formed in the cylinder block to hold a drive shaft, a radial bearing, and a movable spool, or shut-off member, which regulates gas flow within the compressor. An area of the front end of the cylinder block surrounding the central bore is located forward of the axial center of the bearing.

8 Claims, 5 Drawing Sheets

POSITIONAL RELATIONSHIP OF A BEARING IN THE SHUTOFF MEMBER OF A VARIABLE DISPLACEMENT COMPRESSOR

BACKGROUND OF THE INVENTION

1. Field of the Invention

The present invention relates to a variable displacement refrigerant compressor adapted for use in an automotive air conditioning system that lacks a clutch between the compressor and the automotive engine. More specifically, the invention relates to a variable displacement compressor of the type that shuts off the flow of refrigerant gas to the suction chamber while the compressor is in its minimum displacement state by using a shutoff member, which is located in a central bore formed in the cylinder block.

2. Description of the Related Art

For better understanding of the problem solved by the invention, a typical variable displacement refrigerant compressor of the same type as that of the present invention will be explained.

The compressor comprises a housing defining therein a crankcase, a suction chamber receiving refrigerant gas before compression and a discharge chamber receiving refrigerant gas after compression. The housing includes a cylinder block having a front end surface exposed to the crankcase and including a plurality of cylinder bores each receiving therein a working piston. The compressor further comprises a drive shaft rotatably supported in the crankcase, a swash plate supported on the drive shaft to rotate therewith and to tilt with respect to the axis of the drive shaft between minimum and maximum tilt angle positions while moving along the drive shaft, thereby making a wobbling movement at a variable tilt angle. Each piston is slidably received in one of the cylinder bores and is operatively connected to the swash plate such that the wobbling movement of the swash plate at the variable tilt angle is converted into reciprocal movement of the pistons, and the stroke of the pistons in the associated cylinder bores varies accordingly. The housing further includes a suction passage receiving an inflow of refrigerant gas from an air conditioning system, to which the compressor is connected. The suction passage is communicable with the suction chamber.

Formed axially through the cylinder block is a central bore aligned with the drive shaft. One end of the bore opens to the crankcase, and the other end opens to the suction passage. The compressor further includes a shutoff means in the form of a cup-shaped spool slidably fitted in the above central bore for shutting off fluid communication between the suction passage and the suction chamber to stop the inflow of refrigerant gas into the cylinder bores when the swash plate is brought to its minimum displacement location. The rear end of the drive shaft is inserted into the shutoff spool and is supported by a radial bearing mounted on the drive shaft within the shutoff spool. The compressor further includes a displacement control valve for controlling the tilt angle of the swash plate in response to a change in the cooling demand or load.

In this type of compressor, the swash plate tilts in response to the difference between the pressure in the crankcase and the pressure in the cylinder bores. When there is no cooling demand, the swash plate is brought to the minimum angle tilt angle position, and the shutoff spool is moved in the central bore to close the suction passage so the flow of refrigerant gas into the suction chamber is shut off. In this state, the refrigerant gas within the compressor is circulated through the discharge chamber, the crankcase, the suction chamber and the cylinder bores and, simultaneously, lubrication oil contained in and entrained by the refrigerant gas lubricates the internal parts of the compressor.

Regarding compressors of this type, however, there has been no disclosure with reference to the arrangement of the radial bearing relative to the central bore of the cylinder block. In compressors of this type having a relatively short cylinder block and hence a short central bore receiving the shutoff spool, it has been feared that the radial bearing may slide to such an extent that the center of that radial bearing, as defined by an imaginary plane extending perpendicularly to the drive shaft axis and passing through the axial midpoint of the bearing, will come out of the central bore, or move beyond the front end surface of the cylinder block, while the swash plate is being moved toward its maximum tilt angle position. If this occurs, the shutoff member would tend to incline within the central bore with respect to the axis of the drive shaft and become misaligned with the axis of the drive shaft. When the shutoff member is subsequently moved rearward while in an inclined state in conjunction with the movement of the swash plate to its minimum tilt angle position in response to a decrease in the cooling demand, the shutoff member may fail to completely shut off the suction passage so that some of the refrigerant gas in the suction passage may flow into the suction chamber. This would result in performance of the cooling operation even when there is no demand for cooling.

SUMMARY OF THE INVENTION

The present invention was made in light of the above-described disadvantage of a conventional variable displacement refrigerant compressor equipped with a shutoff member. Therefore, an object of the invention is to provide a compressor of the above-described type in which the shutoff member is prevented from being inclined in the central bore of the cylinder block, which permits the shutoff member to completely close the suction passage when the swash plate is moved to its minimum displacement position.

Since the variable displacement refrigerant compressor according to the present invention is substantially the same as the type of compressor described in the BACKGROUND OF THE INVENTION, the description of the general construction of the compressor will not be reproduced here.

The compressor according to the invention includes a suction chamber for receiving gas from an external circuit through a suction passage and a drive shaft extending in a crank case. A swash plate is tiltably mounted on the drive shaft to drive a piston in a cylinder bore to compress the gas. A shutoff member is axially movable with respect to the drive shaft. The shutoff member moves in association with the tilt action of the swash plate. The shutoff member closes the suction passage when the swash plate is held at a minimum tilt angle. The compressor further includes means for keeping the shutoff member parallel with the drive shaft.

In another aspect of the present invention, the compressor comprises a housing defining a crankcase. The housing includes a cylinder block. A cylinder bore is defined in the cylinder block. A drive shaft is rotatably supported in the crankcase. A swash plate is supported on the drive shaft for rotation therewith in unison. The swash plate is tiltable between a maximum tilt angle and a minimum tilt angle with respect to a plane perpendicular to an axis of the drive shaft while moving along the drive shaft. A piston is slidably received in the cylinder bore and is operably connected to the swash plate such that rotation of the swash plate is converted into reciprocal movement of the piston with a variable stroke in the associated cylinder bore. A fluid passage has an inlet and an outlet. Fluid flows from the inlet via the cylinder bore to the outlet. The cylinder block has a receiving bore axially extending therethrough in alignment with the drive shaft. The receiving bore has an inner peripheral surface and opens to the crankcase. The drive shaft has an end extending to the receiving bore. Shutoff means is slidably received in the receiving bore between the end of the drive shaft and the inner peripheral surface of the receiving bore to shut off the fluid passage. The shutoff means has a first section contacting the bearing and a second section contacting the inner peripheral surface. The first section has an axial midpoint. An imaginary plane perpendicular to the axis of the drive shaft and passing through the midpoint lies within the axial length of the second section.

BRIEF DESCRIPTION OF THE DRAWINGS

The above object, features and advantages of the present invention will become apparent to those skilled in the art from the following description of embodiments of the invention. The description is made with reference to the accompanying drawings, wherein.

DETAILED DESCRIPTION OF THE PREFERRED EMBODIMENTS

The following will describe a preferred embodiment of a variable displacement refrigerant compressor of the invention with reference to FIGS. 1 to 5.

Figure 1:
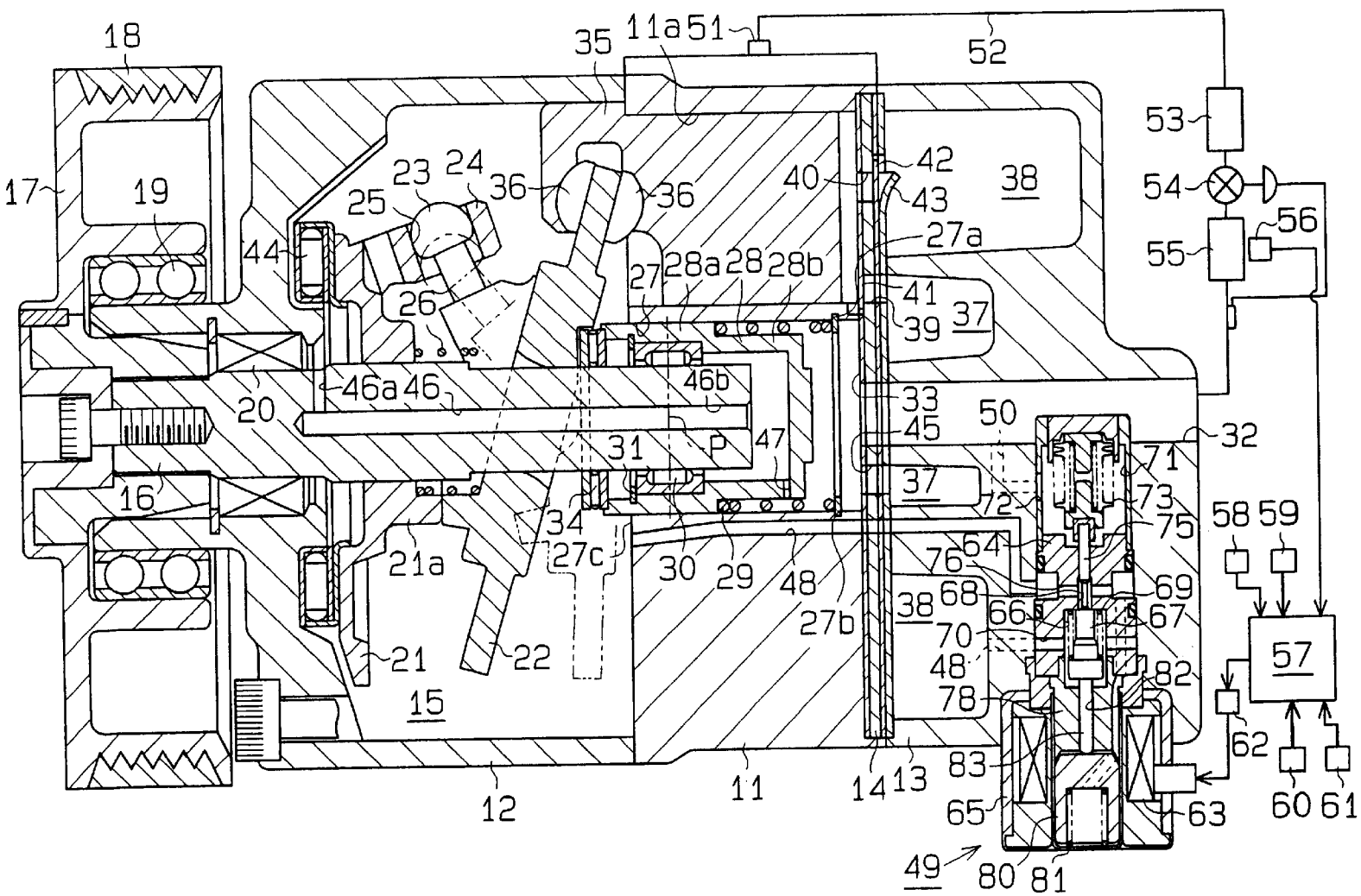
FIG. 1 is a longitudinal cross section of a first embodiment of variable displacement refrigerant compressor showing the compressor in a state of maximum displacement.
Figure 2:
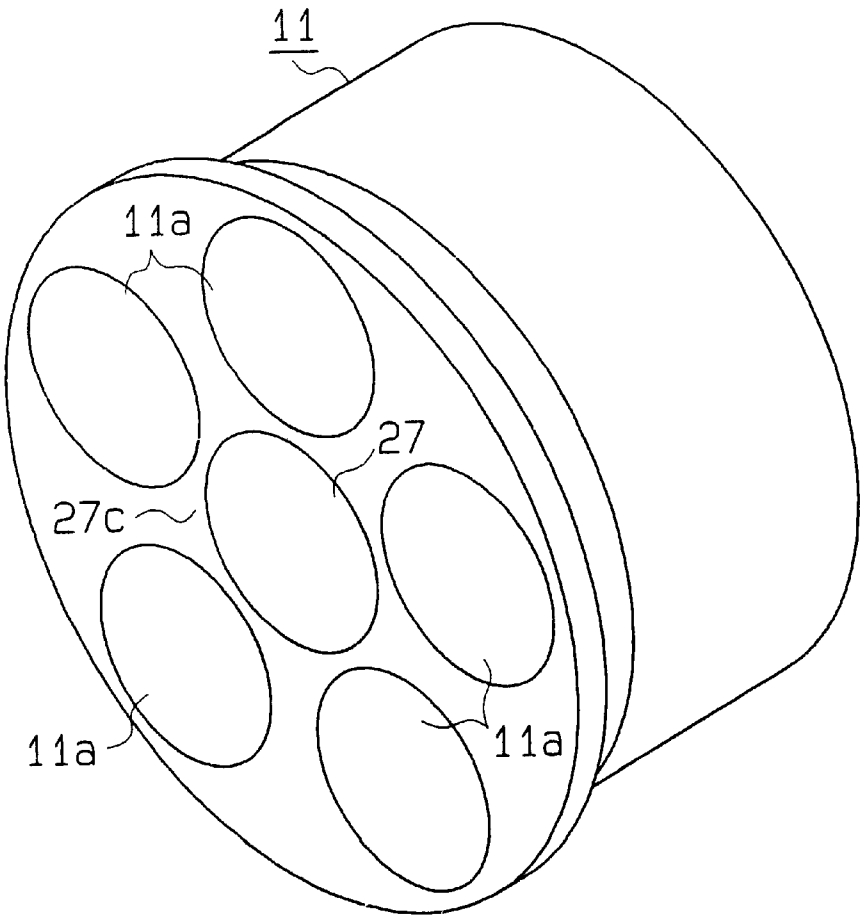
FIG. 2 is a perspective view showing a cylinder block of the compressor of FIG. 1.

Referring to FIGS. 1 and 2, the compressor includes a housing assembly including a cylinder block 11, a front housing 12, which is clamped to the front end of the cylinder block, and a rear housing 13, which is secured to the rear end of the cylinder block 11, and a valve plate 14 is located between the rear housing and the cylinder block 11. The front housing 12 cooperates with the cylinder block 11 to define a crankcase 15. Located in the crankcase 15 is a drive shaft 16 rotatably supported at its front end by the front housing 12 and at the opposite end by the cylinder block 11 by way of a radial bearing 30 and a shutoff spool, or shutoff member 28, which has the form of a cup. The radial bearing 30 and the shutoff member 28 will be described in detail below. The front end of the drive shaft 16 extends out of the crankcase 15, and a pulley 17 is fastened to the front end surface of the drive shaft. The pulley 17 is rotatably supported on a front extension of the front housing 12 by way of an angular bearing 19, which carries both axial and radial loads applied to the pulley 17. The pulley 17 is operatively connected to an engine of a vehicle (not shown) with no intervening clutch. A belt 18 engages the pulley 17. A lip seal 20 is provided between the drive shaft 16 and the front housing 12 to seal the crankcase 15.

A lug plate or a rotor 21 is fixed on the drive shaft 16 for rotation therewith, and a swash plate 22 is supported on the drive shaft 16 to slide along and tilt with respect to the drive shaft 16. The swash plate 22 has a pair of guide pins 23 (only one is shown in the drawings), each having a spherical guide portion at its distal end. Each spherical guide portion is slidably received in an associated guide hole 25 formed at the respective distal end of a pair of guide arms 24 (only one is shown in the drawings) extending from the rotor 21. As is known in the art, such support of the swash plate 22 on the drive shaft 16 and engagement of the guide pin 23 of the swash plate 22 with the associated guide hole 25 of the rotor 21 permits the swash plate 22 to wobble while rotating with the rotor 21 and with the drive shaft 16 at a variable tilt angle.

For the sake of consistency in the description, the tilt angle of the swash plate 22 is defined with respect to an imaginary plane that is perpendicular to the axis of the drive shaft 16.

Figure 3:
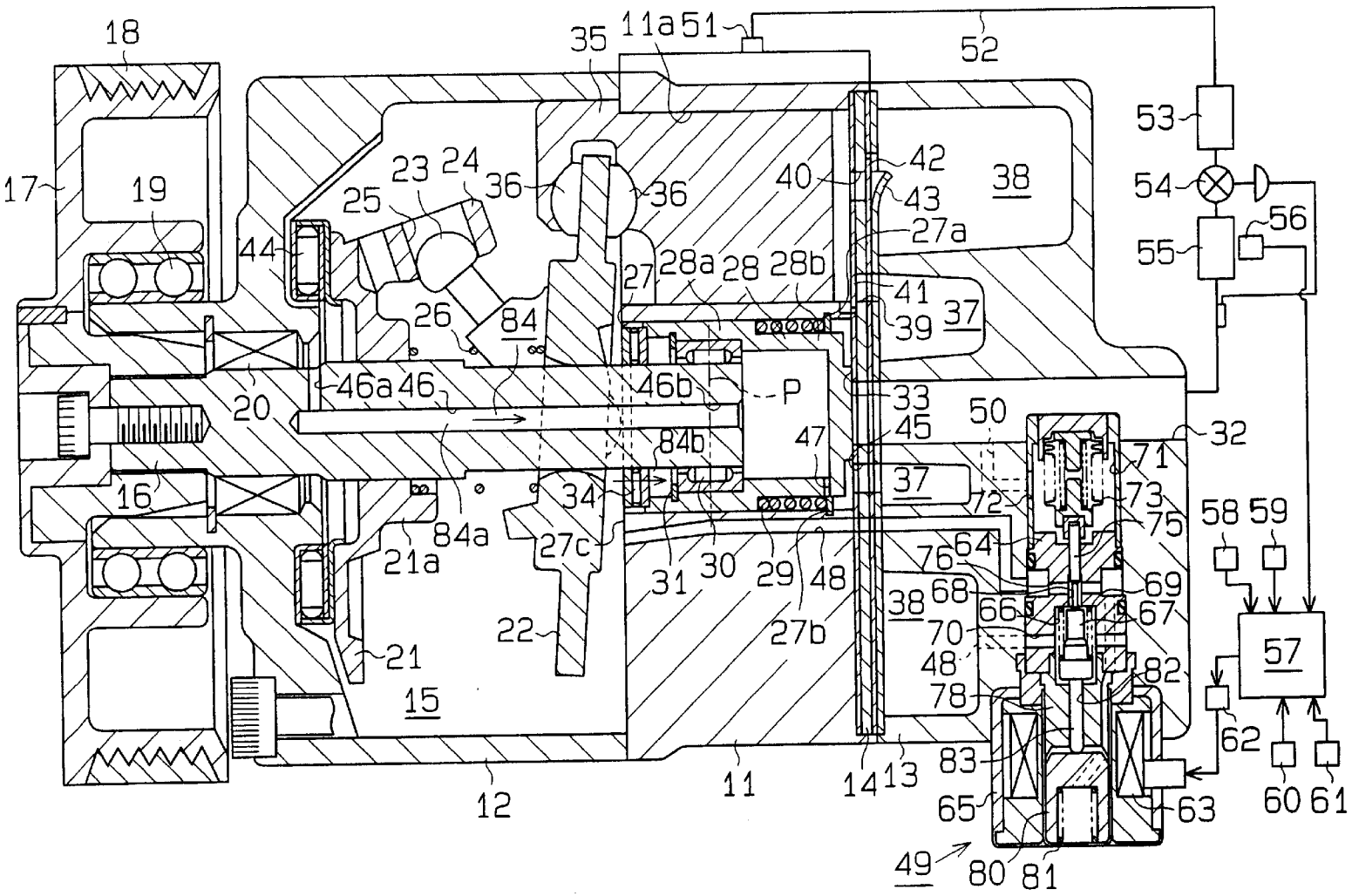
FIG. 3 is a cross section similar to that of FIG. 1, but showing the compressor in a state of minimum displacement.

As seen from a comparison of FIGS. 1 and 3, the swash plate 22 decreases its tilt angle while shifting its axial center toward the cylinder block 11. To limit the maximum tilt angle of the swash plate 22, a stop 21*a* is formed on the rear surface of the rotor 21. A front surface of the swash plate 22 contacts the stop 21*a* when the swash plate 22 is tilted to its maximum angle position as shown in FIG. 1. Between the rotor 21 and the swash plate 22, a front spring 26 is located for urging the swash plate 22 toward its minimum angle position. The front spring 26 pushes the swash plate 22 toward the cylinder block 11.

As shown in the drawings, a central bore 27 is formed through the cylinder block 11 in alignment with, or coaxial to, the drive shaft 16. The central bore 27 has the same diameter throughout its axial length. The central bore 27 slidably accommodates the aforementioned shutoff member 28, which performs the function of shutting off the inflow of refrigerant gas into the compressor as will be described in detail below. The shutoff member 28 is a hollow cylinder with a stepped configuration. The shutoff member 28 has a large diameter section 28*a*, which has an open end, and a small diameter section 28*b*, which has a closed end. As shown in FIG. 1, the rear end of the drive shaft 16 is received in the shutoff member 28 and supported by the radial bearing 30, which is fitted slidably between the inner peripheral surface of the large diameter section 28*a* and the drive shaft 16. The radial bearing 30 is retained in place within the shutoff member 28 by a retainer 31. The central bore 27 has an annular groove 27*a* formed adjacent its rear end. A retainer 27*b* is removably held in the groove 27*a*, and a rear spring 29 is located between the retainer 27*b* and a step, which is between the large and small diameter sections 28*a*, 28*b* of the shutoff member 28. The rear spring 29 urges the shutoff member 28 toward the swash plate 22 against the force exerted by the front spring 26. The urging force of the rear spring 29 is smaller than that of the front spring 26 and, therefore, the resultant urging force of the front and rear springs 26, 29 acts on the swash plate 22, a thrust bearing 34, which will be described in detail later, and the shutoff member 28 to shift them toward the rear housing 13.

The cylinder block 11 further includes five axial cylinder bores 11*a* formed through the cylinder block 11 around the central bore 27. Each cylinder bore 11*a* slidably receives a single-headed piston 35. Each piston 35 is engaged with the swash plate 22 by a pair of front and rear hemispherical shoes 36 so that the wobbling movement of the swash plate 22 is converted into reciprocal sliding movement of each piston 35.

Formed at the radial center of the rear housing 13 is a suction passage 32 aligned with the drive shaft 16 and the shutoff member 28. The front end of the suction passage 32 opens to the central bore 27 of the cylinder block 11 through a central opening in the valve plate 14. The valve plate 14 has an abutment stop surface 33 adjacent to its center opening. When the spool 28 is moved rearwardly to a certain extent, the rear end of the slidable shutoff member 28 contacts the abutment stop surface 33 to shut off the inflow of refrigerant gas flow into the compressor by closing the suction passage 32.

The rear housing 13 cooperates with the valve plate 14 to form a suction chamber 37 and a discharge chamber 38, which are communicable with the cylinder bores 11*a* through suction ports 39 and discharge ports 40 formed through the valve plate 14, respectively. The valve plate 14 includes suction valves 41 and discharge valves 42 for controlling the fluid communication between the cylinder bores 11*a* and the suction and discharge chambers 37, 38 through the suction and discharge ports 39, 40, respectively. In operation, refrigerant gas in the suction chamber 37 is drawn through the suction port 39 into the cylinder bore 11*a* when the associated piston 35 is moved from its top dead center toward its bottom dead center, or during the suction stroke. The refrigerant gas in the cylinder bore 11*a* is compressed when the associated piston 35 moves toward the top dead center, or in the compression stroke. Each piston 35 forces the gas into the discharge chamber 38 when the pressure of the compressed gas increases beyond the predetermined level that causes the discharge valve 42 to open. The maximum degree of discharge valve 42 opening is limited by a retainer 43. The suction chamber 37 in the rear housing 13 is communicable with the central bore 27 in the cylinder block 11 through a port 45 formed in the valve plate 14. Thus, the refrigerant gas introduced into the suction passage 32 from an external air conditioning circuit flows through the port 45 into the suction chamber 37. When the shutoff member 28 is moved into contact with the abutment surface 33, however, the fluid communication between the suction passage 32 and the suction chamber 37 is discontinued, or shut off.

The thrust bearing 34 is slidably supported on the drive shaft 16 between the swash plate 22 and the shutoff member 28 for carrying an axial thrust exerted by the swash plate 22 and also for preventing the rotation of the swash plate 22 from being transmitted to the shutoff member 28. Another thrust bearing 44 is provided between the rotor 21 and the front housing 12 for receiving the compression reaction force, which acts on the rotor 21 via the pistons 35, shoes 36, swash plate 22 and guide pin 23.

The drive shaft 16 has an internal axial bleeding passage 46, the front end of which communicates with the crankcase 15 through an inlet port 46*a* adjacent the lip seal 20 and the rear end of which is opened into the interior of the shutoff member 28 through an outlet port 46*b*. A bleeding port 47 is formed in the shutoff member 28. The bleeding port 47 permits fluid communication between the interior of the shutoff member 28 and the central bore 27 in the cylinder block 11. Thus, the crankcase 15 is connected to the suction chamber 37 for releasing the crankcase pressure.

On the other hand, the crankcase 15 is also communicable with the discharge chamber 38 through a passage 48 formed in the cylinder block 11, valve plate 14 and rear housing 13. A displacement control valve assembly 49, which will be described in detail later, is located in the passage 48 for changing the opening of the passage 48 by adjusting the valve opening in the displacement control valve assembly 49. The part of the passage 48 that is formed in the rear housing 13 includes two parts, one extending from the discharge chamber 38 to the displacement control valve assembly 49 and the other from the valve assembly 49 to the crankcase 15. Another passage 50 is formed in the rear housing 13 for connecting the suction passage 32 to the control valve assembly 49.

Reference numeral 51 designates a delivery port through which compressed refrigerant gas is delivered to the external air conditioning circuit 52, to which the compressor is connected. The air conditioning circuit 52 includes a condenser 53, which is connected to the delivery port 51 of the compressor, an expansion valve 54, and an evaporator 55, which is connected to the suction passage 32 of the compressor. The expansion valve 54 is the type that is operated automatically to control the flow of refrigerant to the evaporator 55 in response to the refrigerant gas temperature at the outlet of the evaporator 55. A temperature sensor 56 monitors the temperature of the evaporator 55 and sends a signal indicative of the detected temperature to a control computer 57. The control computer 57 has inputs connected to a setting device 58 for presetting a desired passenger compartment temperature, a temperature sensor 59 for monitoring the current passenger compartment temperature, an on/off control switch 60 for turning on or off the air conditioning system, and a speed sensor 61 for monitoring the current engine speed. The output of the control computer 57 is connected a drive circuit 62, which is in turn connected to a solenoid 63 incorporated in the aforementioned displacement control valve assembly 49. Responding to various input signals from the setting device 58, sensors 56, 59, 61 and the control switch 60, the control computer 57 sends to the drive circuit 62 a control signal representing a desired magnitude of electric current to be applied to the solenoid 63. The input current to the solenoid 63 may be determined from other additional input signals to the control computer 57 depending on further requirements of air conditioning, such as a signal representative of the outside temperature.

The displacement control valve assembly 49 includes a valve housing 64 and a solenoid assembly 65, which are joined together into a single unit. The valve housing 64 and the solenoid assembly 65 cooperate to form a valve chamber 66, in which a valve element 67 is movably located. An axial bore 68 is formed in the valve housing 64. One end of the axial bore 68 opens into the valve chamber 66 and the opposite end opens to a bellows chamber 71, which is connected with the suction passage 32 through the passage 50 and an inlet port 72. A spring 69 is installed in the valve chamber 66 between the valve element 67 and the end surface of the valve chamber 66 adjacent to the axial bore 68. The spring 69 urges the valve element 67 downward, as seen in FIG. 1, away from the bore 68. The valve chamber 66 communicates with the discharge chamber 38 through a port 70 bored in the valve housing 64 and through the passage 48 in the rear housing 13. The upper surface of the valve chamber 66 forms a valve seat against which the valve element 67 may abut.

The bellows chamber 71 communicates through an inlet port 72 and the passage 50 with the suction passage 32. A bellows 73 is located in the bellows chamber 71. The bellows 73 is responsive to the suction pressure Ps and is linked to the valve element 67 by way of a rod 75. The rod 75 is slidably received in the bore 68 and is connected at its distal end to the valve element 67. As the suction pressure Ps applied to the bellows 73 is increased, the length of the bellows 73 is reduced, which pulls the valve element 67 upward. When the suction pressure is decreased, the length of the bellows 73 increases, which pushes the valve element 67 downward. The distal end of the rod 75 has a reduced diameter adjacent to the valve element 67 to provide a space, or passage, in the bore 68 for refrigerant gas to flow through. A port 76 is formed in the valve housing 64 to intersect the bore 68 adjacent to the reduced diameter portion of the rod 75. The port 76 extends radially to the passage 48, which connects the crankcase 15 and the bore 68. Therefore, when the valve element 67 is opened to connect the valve chamber 66 and the bore 68, the discharge chamber 38 communicates with the crankcase 15 through the passage 48 and the displacement control valve assembly 49.

The solenoid assembly 65 includes a stationary iron core 78 and a cylindrical cup-shaped iron core, or plunger 80, which is movably located immediately below the stationary core 78. A spring 81 is provided in the plunger 80 for urging the plunger 80 toward the stationary core 78. The spring 81 has an urging force smaller than that of the spring 69 in the valve chamber 66. A guide bore 82 is formed axially in the iron core 78 for slidably receiving a rod 83, which is formed integrally with the valve element 67 and which extends beyond the lower surface of the stationary core 78. The rod 83 is urged so that its distal end is kept in contact with the plunger 80 under the influence of the resultant of the urging forces of the springs 69 and 81, and the movement of the plunger 80 is transmitted to the rod 83 and to the valve element 67. The solenoid assembly 65 further includes a coil, or a cylindrical solenoid 63, located to surround the stationary core 78 and the plunger 80, so that the plunger 80 is moved toward the stationary iron core 78 by magnetic attraction when the solenoid 63 is energized. As indicated earlier, the solenoid 63 is energized in response to an electric current of a variable magnitude supplied from the drive circuit 62, which is in response to a control signal generated by the control computer 57. The attraction force or the distance of displacement of the plunger 80 toward the iron core 78 depends upon the magnitude of the energizing current.

Now, the positional relationship between the front end surface of the cylinder block 11 and the radial bearing 30 will be discussed. As shown in FIGS. 1 to 3, the front end surface of the cylinder block 11, including the peripheral surface 27*c* adjacent to the front opening of the central bore 27, is formed flat, and this flat surface is provided relative to the radial bearing 30 such that a plane defined by the flat end surface of the cylinder block 11 is positioned forward of, i.e., further toward the swash plate 22 than (or on the front side of) an imaginary plane P perpendicular to the axis of the drive shaft 16 that passes through the midpoint of the radial bearing 30 as determined along the axis of the drive shaft on which the bearing is fitted (or that passes through the load bearing area where the bearing 30 contacts the shutoff member 28). Or, viewed another way, the front end of the central bore is located on the front side of a plane perpendicular to the axis of the drive shaft that bisects the bearing (or that bisects the load bearing area where the bearing contact the shutoff member 28). As seen from FIG. 1, this relationship is maintained when the compressor is operating at its maximum displacement, the swash plate 22 tilted to its maximum angle, and the shutoff member 28 is shifted to its foremost position in the central bore 27.

The following will explain the operation of the above-described variable displacement refrigerant compressor.

In the operative state of the air conditioning system with the control switch 60 turned on, if the current vehicle compartment temperature detected by the sensor 59 is higher than the desired temperature preset by the device 58 and hence there is a cooling load, the control computer 57 commands the drive circuit 62 to energize the solenoid 63 with an electric current having a magnitude determined by a control signal generated by the control computer 57. Accordingly, a magnetic attraction force corresponding to the current magnitude is developed to urge the plunger 80 toward the stationary iron core 78, so that the plunger 80 pushes the rod 83 and hence the valve element 67 against the force of the spring 69 in a direction that reduce the valve opening, i.e., the opening defined between the valve element 67 and its valve seat. On the other hand, the bellows 73 in the bellows chamber 71 is subjected to a suction pressure Ps of the refrigerant gas conducted through the passages 32 and 50. Accordingly, the bellows 73 is displaced to change its length, and this displacement is transmitted to the valve element 67 through the rod 75. As stated earlier, the bellows 73 reduces its length as the suction pressure Ps applied thereto is increased, and vice versa. Therefore, the position of the valve element 67, which is subjected to the forces exerted by the plunger 80, the spring 69 and the bellows 73, is determined by the equilibrium of these forces.

If the cooling load becomes greater with an increase in the difference between the compartment temperature detected by the sensor 59 and the desired temperature set by the device 58, the suction pressure Ps becomes higher and the control computer 57 responding to such an increased cooling load commands the drive circuit 62 to energize solenoid 63 with a current of a greater magnitude. Accordingly, the plunger 80 is attracted toward the stationary core 78 by an increased attraction force thereby to reduce the valve opening. This increases the resultant force that reduces the valve opening. This in turn lowers the suction pressure Ps required for shifting the valve element 67 in the direction to reduce the valve opening. In other words, as the magnitude of current applied to the solenoid 63 is increased, the displacement control valve assembly 49 functions such that the suction pressure Ps required to reduce the valve opening is decreased. With the valve opening thus reduced, the flow rate of refrigerant gas under discharge pressure Pd through the passage 48 into the crankcase 15 is reduced. On the other hand, some of the refrigerant gas in the crankcase 15 then flows into the suction chamber 37 through the bleeding passage 46 and the port 47, which decreases the crankcase pressure Pc. Since the suction pressure Ps is higher under a greater cooling load, the pressure in the cylinder bores 11*a* is also higher. Accordingly, the difference between the crankcase pressure Pc and the pressure in the cylinder bores 11*a* becomes smaller, which moves the swash plate 22 in the direction to increases its tilt angle, and the compressor thus operates with a larger displacement.

If the valve element 67 is further moved into contact with its seat to close the bore 68, the flow of refrigerant gas under discharge pressure Pd into the crankcase 15 is stopped, the crankcase pressure Pc becomes substantially the same as the suction pressure Ps, the swash plate 22 is moved to its maximum tilt angle position, and the compressor operates at its maximum displacement. As mentioned earlier, the stop 21*a* on the rear surface of the rotor 21 prevents the swash plate 22 from tilting further than the maximum tilt position.

If the cooling load becomes smaller due to a decrease in the difference between the passenger compartment temperature and the desired temperature, the suction pressure Ps becomes lower and the control computer 57, which is responsive to the decreased cooling demand, commands the drive circuit 62 to energize solenoid 63 with a current of a smaller magnitude, so that the plunger 80 is attracted toward the stationary core 78 by a decreased attraction force and the valve opening is increased. This increases the suction pressure Ps required for moving the valve element 67 in the direction to reduce the size of the valve opening. In other words, as the magnitude of current to the solenoid 63 is decreased, the displacement control valve assembly 49 functions such that the suction pressure Ps required to reduce the valve opening is increased. When the valve opening is thus enlarged, the flow rate of refrigerant gas from the discharge chamber 38 through the passage 48 into the crankcase 15 is increased, which raises the crankcase pressure Pc. Accordingly, the difference between the crankcase pressure Pc and the pressure in the cylinder bores 11*a* becomes greater, which moves the swash plate 22 rearward to a smaller tilt angle and results in a smaller displacement.

As the cooling load is further reduced to an extent that the passenger compartment temperature drops to substantially the preset level, the temperature of the evaporator 55 becomes low enough to cause frosting. If the evaporator temperature detected by the sensor 56 falls below a level at which frosting of the evaporator 55 is about to occur, the control computer 57 commands the drive circuit 62 to de-energize the solenoid 63. Because the attraction force is no longer present, the plunger 80 is moved to its lowermost position, which is shown in FIG. 3, under the influence of the spring 69, which acts against the spring 81. Because the valve opening is wide-open, refrigerant gas under discharge pressure Pd is drawn into the crankcase 15 to build up the crankcase pressure Pc. When the crankcase pressure Pc increases, the swash plate 22 is moved to its minimum tilt angle position.

The control computer 57 also commands the drive circuit 62 to de-energize the solenoid 63 in response to an off signal from the control switch 60. That is, when the air conditioner is turned off, the solenoid 63 is de-energized, or turned off, and therefore, the swash plate 22 is kept in its minimum tilt angle position.

The valve opening in the displacement control valve assembly 49 depends on the magnitude of electric current applied to the solenoid 63. That is, when the solenoid 63 is energized by a current with a greater magnitude, the valve operation is performed under a lower suction pressure Ps. When the solenoid 63 is energized by a current with a lower magnitude, on the other hand, the valve operation is performed under a higher suction pressure Ps. That is, the variable electric current applied to the solenoid 63 changes the level of the suction pressure Ps required for reducing the valve opening, and the displacement control valve assembly 49 adjusts the tilt angle of the swash plate 22 to control the compressor displacement to maintain the value of the suction pressure Ps required for closing the valve element 67. In other words, the displacement control valve assembly 49 changes the value of the suction pressure Ps required to close the valve by varying the magnitude of input current to the solenoid 63 and also allows the compressor to operate at minimum displacement regardless of the suction pressure Ps.

As the swash plate 22 slides gradually toward the cylinder block 11 while reducing its tilt angle, the shutoff member 28 is shifted accordingly while compressing the spring 29. Because the shutoff member 28 continuously reduces the cross sectional area of the outlet opening of the suction passage 32, the flow of refrigerant gas from the suction passage 32 into the suction chamber 37 is decreased. Accordingly, the volume of refrigerant gas introduced into the cylinder bores 11*a* from the suction chamber 37 is continuously reduced and, therefore, the delivery of compressed gas and the discharge pressure Pd drop continuously. A continuous change of the discharge pressure Pd from the maximum to the minimum displacement prevents a rapid change in the torque required to drive the compressor, which reduces shock due to a rapid torque change.

If the swash plate 22 is moved to its minimum angle position, the shutoff member 28 is simultaneously brought in contact with the abutment surface 33 of the valve plate 14, which closes the suction passage 32, as shown in FIG. 3, and the inflow of refrigerant gas from the air conditioning circuit 52 into the suction chamber 37 is shut off. Since the minimum tilt angle of the swash plate 22 is not zero degrees, but is a couple of degrees with respect to the aforementioned reference plane, as seen from FIG. 3, refrigerant gas in the cylinder bores 11*a* is discharged into the discharge chamber 38 as long as the engine rotates the drive shaft 16. Thus, refrigerant gas forced into the discharge chamber 38 flows through the passage 48 and the wide-open valve opening of the displacement control valve assembly 49 into the crankcase 15. From there, the gas flows through the bleeding passage 46 in the drive shaft 16, through the port 47 in the shutoff member 28, through the port 45 in the valve plate 14 and into the suction chamber 38. Then, the refrigerant gas in the suction chamber 38 is again discharged into the discharge chamber 38. Thus, a recirculating passage is formed for the refrigerant gas to flow in the compressor when it is operating in the state of minimum displacement, and the compressor parts are lubricated by lubricating oil contained in and entrained by the recirculating refrigerant gas.

If the compartment temperature is raised beyond the preset temperature while the compressor is running at minimum displacement with the control switch 60 turned on, the control computer 57 commands the drive circuit 62 to energize the solenoid 63, and the valve opening is reduced. This decreases the crankcase pressure Pc, and the spring 29 starts to expand, which causes the shutoff member 28 to move away from the abutment surface 33. Simultaneously, the swash plate 22 moves toward its maximum angle position. As the swash plate 22 moves continuously toward the rotor 21 while increasing its tilt angle, the cross sectional area of the outlet opening of the suction passage 32 increases, which increases the flow of refrigerant gas from the suction passage 32 into the suction chamber 37. Accordingly, the volume of refrigerant gas introduced into the cylinder bores 11*a* from the suction chamber 37 is continuously increased, and the delivery of compressed gas and the discharge pressure Pd are also increased in a continuous manner. The continuous change of the discharge pressure Pd during the compressor operation from its minimum toward its maximum displacement prevents rapid changes, or shocks, in the compressor driving torque.

If the vehicle engine is stopped, torque is no longer transmitted to the drive shaft 15. Thus, the compressor is stopped and current application to the solenoid 63 of the displacement control valve assembly 49 is also stopped. Therefore, the passage 48 is wide-open and the swash plate 22 is brought to its minimum angle position.

Referring specifically to FIG. 1, when the shutoff member 28 has moved to its leftmost position and the swash plate 22 is at the maximum tilt angle, the surface of the peripheral area 27*c* on the front end of the cylinder block 11 is located forward of the axial center of the radial bearing 30, which is defined by the imaginary plane P. Viewed another way, the front end of the central bore 27 is located forward of the axial center of the radial bearing 30 (or forward of the axial center of the load bearing area where the radial bearing contacts the shutoff member 28).

Figure 4:
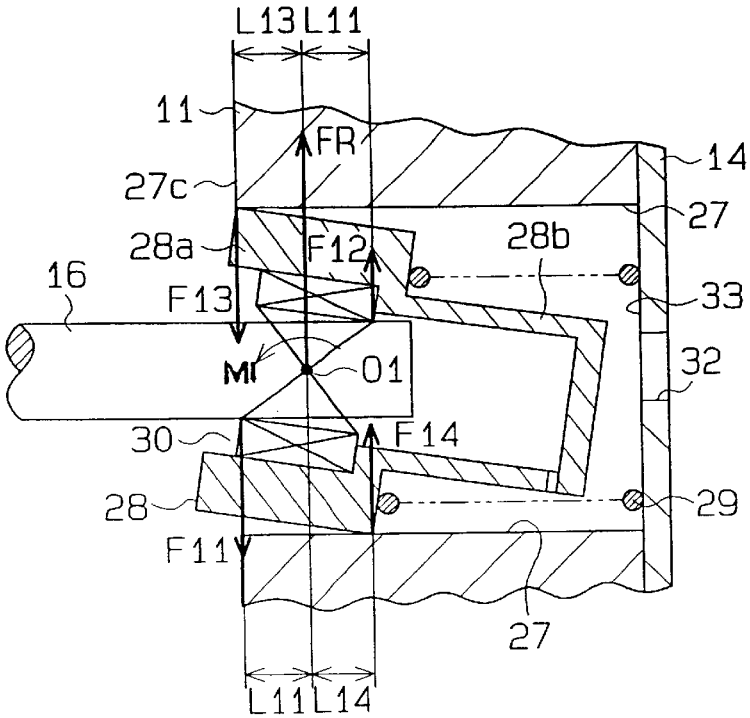
FIG. 4 is a fragmentary cross section of the compressor of FIGS. 1 and 2, illustrating a moment acting on a shutoff member of the compressor.

The radial load FR applied to the drive shaft 16 during the compressing operation of the pistons 35 is received by the inner peripheral surface of the central bore 27 via the radial bearing 30 and the shutoff member 28. If the shutoff member 28 is caused to incline relative to the axis of the drive shaft 16, as shown in FIG. 4, because of external force such as vibration, the radial load FR can be broken into two components F11 and F12, which act in opposite directions, at contact points defined by the drive shaft 16 and the front and rear edges of the radial bearing 30, respectively, as shown in FIG. 4. To counteract these two components F11 and F12, two forces F13 and F14 are present at contact points defined by the inner peripheral surface of the central bore 27 and the front and rear edges of the large diameter section 28*a* of the shutoff member 28, respectively. Under such circumstances, a moment M1 about the point 01, which represents the center of the radial bearing 30, can be expresses as follows:

$$M1=F11\cdot L11+F12\cdot L11+F13\cdot L13+F14\cdot L14 \quad (1)$$

Since the distances L11, L13 and L14 and the forces L11–L14 are all positive, M1 is also positive (i.e., M1>0).

Figure 5:
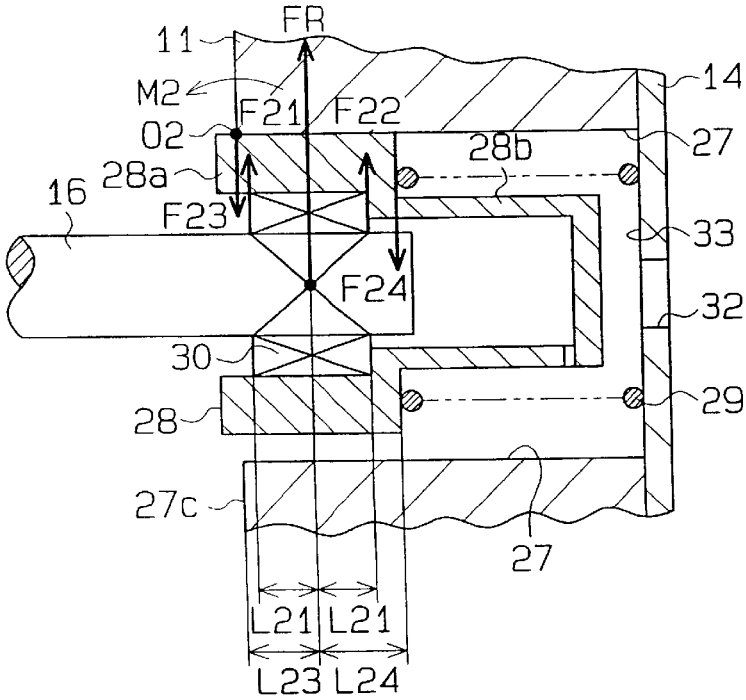
FIG. 5 is a cross section similar to that of FIG. 4 illustrating another moment acting on the shutoff member.

Therefore, the shutoff member 28 will not maintain the illustrated inclined position, but will be turned about the point 01 to contact the inner peripheral surface of the central bore 27 as shown in FIG. 5, whereupon the shutoff member 28 will resume alignment with the drive shaft 16.

Suppose the condition of the shutoff member 28 is as illustrated in FIG. 5. The radial load FR can be broken into two components F21 and F22 acting in the same direction at contact points defined by the drive shaft 16 and the front and rear edges of the radial bearing 30, respectively. To counteract these two component forces F21 and F22, a force F23 is developed at a contact point 02, which is defined by the outer peripheral surface of the large diameter section 28*a* of the shutoff member 28 and the front edge of the central bore 27, and another force F24, which is located at a contact point between the inner peripheral surface of the central bore 27 and the rear edge of the large diameter section 28*a* of the shutoff member 28. The equilibrium state of these forces can be expressed by the following equations:

$$F21+F22=FR \quad (2)$$

$$F23+F24=F21+F22\ (=FR) \quad (3)$$

A moment M2 about the point 02 can be expressed as follows:

$$M2=F21\cdot(L23-L21)+F22\cdot(L23+L21)+F24\cdot(L23+L24) \quad (4)$$

It follows from the above equations (2) and (3) that:

$$F21=F22=FR/2 \quad (5)$$

and also that:

$$F23=FR\cdot L24/(L23+L24) \quad (6)$$

$$F24=FR\cdot L23/(L23+L24) \quad (7)$$

From the equations (5)–(7), equation (4) can be changed as follows:

$$M2=FR\cdot(L23-L21)/2+FR\cdot(L23+L21)/2+[L23/(L23+L24)]\cdot FR\cdot(L23+L24)=2FR\cdot L23$$

Since the distance L23 and the force FR are both positive, the moment M2 is also positive (i.e., M2>0). Therefore, the shutoff member 28 is subjected to a moment that acts around the point 02 and forces the shutoff member 28 into contact with the inner peripheral surface of the central bore 27. In other words, the shutoff member 28 is subjected to a moment that prevents it from inclining relative to the drive shaft 16.

Consequently, while the swash plate 22 is being displaced from the maximum tilt angle position of FIG. 1 to the minimum tilt angle position of FIG. 3, the shutoff member 28 slides smoothly within the central bore 27 toward the suction passage 32 without being inclined with respect to the drive shaft 16. The result is that the suction passage 32 can be closed securely in the minimum delivery state of the compressor.

As is now apparent, because the compressor of the above embodiment is constructed such that peripheral surface 27*c* on the front end of the cylinder block 11 adjacent the front opening of the central bore 27 (or the front end of the central bore 27) is located forward of the axial center of the radial bearing 30 (or the axial center of the load bearing area between the radial bearing 30 and the shutoff member 28), as defined by the plane P, even when the shutoff member 28 is moved to its foremost position, that is, when the swash plate 22 is tilted to its maximum angle, the shutoff member 28 will not be inclined with respect to the drive shaft while the shutoff member 28 is moving toward the rear housing 13 in conjunction with the movement of the swash plate 22 from the maximum tilt angle position toward the minimum tilt angle position. Thus, the shutoff member 28 can perform its intended function to securely shut off the suction passage 32 when the swash plate 22 is brought to the minimum tilt angle position when there is no cooling demand. Thus, the compressor performs its minimum displacement operation without introducing refrigerant gas into the suction chamber 37 from the suction passage 32.

Additionally, because the entire front end surface of the cylinder block 11 including the peripheral surface 27*a* is formed flat, the tendency for the shutoff member 28 to incline is further suppressed. Apparently, the flat configuration of the front end surface is advantageous in machining the cylinder block 11.

Figure 6:
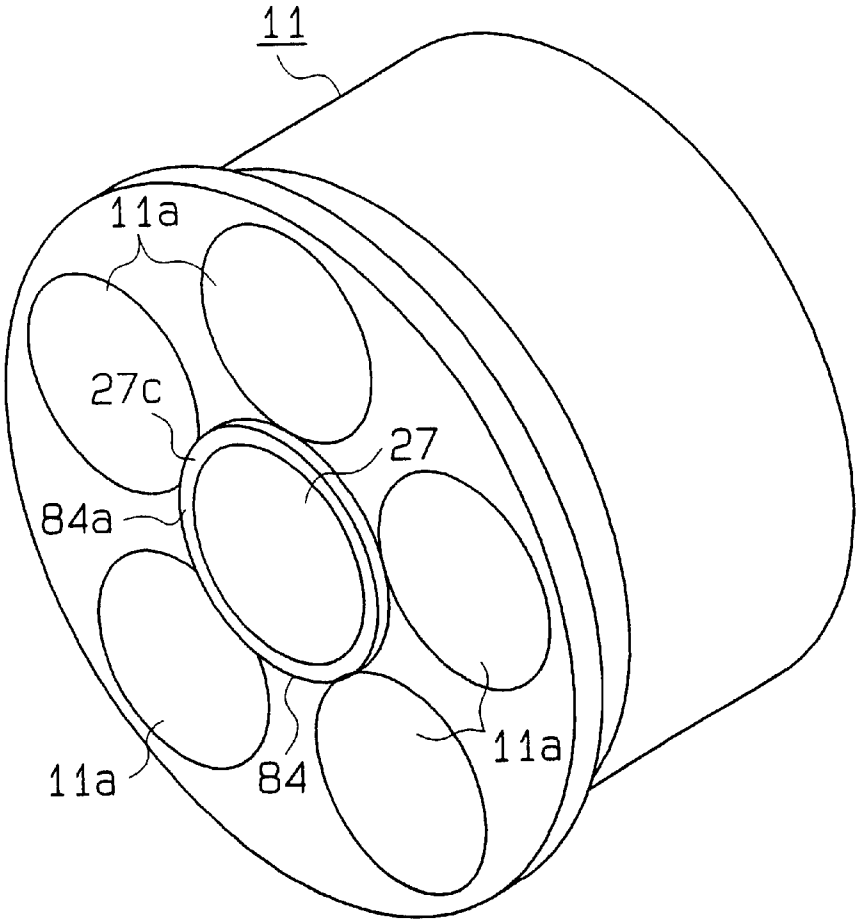
FIG. 6 is a perspective view showing a cylinder block of a second embodiment of a variable displacement refrigerant compressor according to the invention.

FIG. 6 shows a second preferred embodiment of the variable displacement refrigerant compressor according to the present invention. This embodiment differs from the first embodiment in that the front end surface of the cylinder block 11 includes, at the area adjacent to the front opening of the central bore 27, an annular projection 84, which is formed such that its inner circular surface forms a part of the inner peripheral surface of the central bore 27. The front end surface 84*a* of the annular projection 84, which corresponds to the peripheral surface 27*c* in the first embodiment, is formed flat. In the assembled condition of the compressor, the front end surface 84*a* of the projection 84 on the cylinder block 11 is positioned forward of the axial center of the radial bearing 30 when the shutoff member 28 is moved to its foremost position. Therefore, the same effects achieved in the first embodiment are accomplished in the second embodiment. Additionally, the cylinder block 11 of the second embodiment offers an advantage that the compressor can be compact because the axial dimension of the cylinder block 11 can be shortened by the axial length of the projection.

While the invention has been described and illustrated with reference to the specific embodiments, it is to be understood that the invention can be changed or modified in various other ways without departing from the spirit or scope thereof, as exemplified below.

A recess may be formed on the front end surface of the cylinder block at a location other than the peripheral surface area 27*c*.

For the purpose of controlling the tilt angle of the swash plate 22, a separate fluid chamber may be provided in the compressor housing, instead of using the crankcase pressure Pc for the that purpose.

The bleeding passage may be provided between the crankcase 15 and the suction chamber 37, and the displacement control valve assembly 49 is located in the bleeding passage.

The above embodiments were described as so-called clutchless compressors, which dispense with a clutch. Otherwise, a clutch is usually connected between the vehicle engine and the drive shaft of the compressor. However, the compressor according to the invention may be connected to a clutch. In such a case, the clutch is kept engaged while the control switch 60 is on, but it is kept disengaged when the switch remains off, i.e., when there is no need for air conditioning and, therefore, the drive shaft of the compressor does not need be driven.

What is claimed is:

1. A variable displacement compressor comprising:

a housing defining a crankcase, the housing including a cylinder block defining a cylinder bore and a central bore, the cylinder block having a front surface extending from the front end of the central bore to the periphery of the cylinder block, the cylinder bore and the central bore having parallel axes, wherein the central bore has a cylindrical surface and a front end of the central bore opens to the crankcase at a front surface of the cylinder block, and the front surface of the cylinder block is generally planar and perpendicular to the axis of the central bore;

a drive shaft supported by the housing, the drive shaft having a front end and a rear end, wherein a mid-portion of the drive shaft is located in the crank case and the rear end of the drive shaft is located in and coaxial to the central bore;

a swash plate supported on the drive shaft, the swash plate being pivotally supported to rotate integrally with the drive shaft and to incline with respect to a plane perpendicular to the axis of the drive shaft between a maximum inclination and a minimum inclination, wherein the swash plate moves generally in the axial direction of the drive shaft when the inclination changes;

a piston located in the cylinder bore, the piston being connected to the swash plate such that rotation of the swash plate is converted to reciprocal movement of the piston, and the stroke of the piston is determined by the inclination of the swash plate;

a fluid passage having an inlet and an outlet, wherein fluid flows from the inlet to the outlet via the cylinder bore; and a hollow, cylindrical shutoff member located in the central bore between the drive shaft and the cylindrical surface for shutting the fluid passage, the shutoff member having an inner surface, wherein the shutoff member moves axially along the central bore when the inclination of the swash plate changes such that, when the inclination of the swash plate increases, the shutoff member follows the swash plate toward the front end of the drive shaft and a front section of the shutoff member loses contact with the cylindrical surface of the central bore, the shutoff member having a radial load bearing area on its inner surface for bearing radial loads applied between the drive shaft and the shutoff member, the front end of the central bore remaining on the front side of a plane perpendicular to the axis of the drive shaft that bisects the load bearing area, regardless of the axial position of the shutoff member.

2. The variable displacement compressor of claim 1, wherein a bearing is located between the shutoff member and the drive shaft, and the outer surface of the bearing contacts the inner surface of the shutoff member at the radial load bearing area.

3. The variable displacement compressor according to claim 2, wherein an air conditioning circuit is connected to the fluid passage.

4. The variable displacement compressor according to claim 1, wherein the entire front surface of the cylinder block lies in a single plane.

5. A variable displacement compressor comprising:

a housing defining a crankcase, the housing including a cylinder block defining a cylinder bore and a central bore, the central bore having a cylindrical surface, wherein the cylinder bore and the central bore have parallel axes and the axis of the cylinder bore is spaced radially from the axis of the central bore, the cylinder block having a planar front wall extending radially from a front opening of the central bore to at least the cylinder bore, the planar front wall being perpendicular to the axis of the central bore;

a drive shaft supported by the housing, the drive shaft having a front end and a rear end, wherein a mid-portion of the drive shaft is located in the crank case and the rear end of the drive shaft is located in and coaxial to the central bore;

a swash plate supported on the drive shaft, the swash plate being pivotally supported to rotate integrally with the drive shaft and to incline with respect to a plane perpendicular to the axis of the drive shaft between a maximum inclination and a minimum inclination, wherein the swash plate moves generally in the axial direction of the drive shaft when the inclination changes;

a piston located in the cylinder bore, the piston being connected to the swash plate such that rotation of the swash plate is converted to reciprocal movement of the piston, and the stroke of the piston is determined by the inclination of the swash plate;

a fluid passage having an inlet and an outlet, wherein fluid flows from the inlet to the outlet via the cylinder bore; and a hollow, cylindrical shutoff member located in the central bore between the drive shaft and the cylindrical surface for shutting the fluid passage, the shutoff member having an inner surface, wherein the shutoff member moves axially along the central bore when the inclination of the swash plate changes such that, when the inclination of the swash plate increases, the shutoff member follows the swash plate toward the front end of the drive shaft and a front section of the shutoff member loses contact with the cylindrical surface of the central bore, wherein the shutoff member has a radial load bearing area on its inner surface for bearing radial loads applied between the drive shaft and the shutoff member, the front end of the central bore remaining on the front side of a plane perpendicular to the axis of the drive shaft that bisects the load bearing area, regardless of the axial position of the shutoff member.

6. The variable displacement compressor of claim 5, wherein a bearing is located between the shutoff member and the drive shaft, and the outer surface of the bearing contacts the inner surface of the shutoff member at the radial load bearing area.

7. The variable displacement compressor according to claim 5, wherein an air conditioning circuit is connected to the fluid passage.

8. The variable compressor according to claim 5, wherein the planar front wall has a front surface lying in a single plane.

* * * * *